US008875787B2

(12) United States Patent
Tassaroli

(10) Patent No.: US 8,875,787 B2
(45) Date of Patent: Nov. 4, 2014

(54) ELECTROMECHANICAL ASSEMBLY FOR CONNECTING A SERIES OF GUNS USED IN THE PERFORATION OF WELLS

(75) Inventor: Carlos Jose Tassaroli, Mendoza (AR)

(73) Assignee: Tassaroli S.A., Mendoza (AR)

( * ) Notice: Subject to any disclaimer, the term of this patent is extended or adjusted under 35 U.S.C. 154(b) by 219 days.

(21) Appl. No.: 13/555,528

(22) Filed: Jul. 23, 2012

(65) Prior Publication Data

US 2013/0043074 A1 Feb. 21, 2013

(30) Foreign Application Priority Data

Jul. 22, 2011 (AR) ..... P110102655

(51) Int. Cl.
*E21B 29/02* (2006.01)
*E21B 43/1185* (2006.01)

(52) U.S. Cl.
CPC ..... *E21B 43/1185* (2013.01)
USPC ..... 166/297; 166/55.2; 175/2

(58) Field of Classification Search
USPC ..... 166/297, 298, 55, 55.2; 175/2; 102/307; 89/1.15
See application file for complete search history.

(56) References Cited

U.S. PATENT DOCUMENTS

| | | | | |
|---|---|---|---|---|
| 2,667,836 | A * | 2/1954 | Church et al. | 175/4.53 |
| 5,571,986 | A * | 11/1996 | Snider et al. | 102/275.11 |
| 5,680,905 | A * | 10/1997 | Green et al. | 175/4.54 |
| 2012/0006217 | A1 * | 1/2012 | Anderson | 102/215 |

* cited by examiner

*Primary Examiner* — Yong-Suk (Philip) Ro

(57) ABSTRACT

An electromechanical assembly for a series of guns used in the perforation of petroleum producing wells. Each gun is a cylindrical housing having a charge-carrier loaded with explosive charges in contact with a detonating cord which contacts an electronically activated detonator. The guns are joined by intermediary joints and terminate in a bottom sub on its lower end and a firing head at its upper end. The charge-carrier of each gun is detonated, beginning with the bottom-most gun. Insulating end plates are on the lower and upper ends of the carrier for centering and anchoring the charge-carriers. An electrical wire runs from a retractable contact pin in each carrier, through the intermediary joint which has a changeover switch sensitive to the high pressures produced by the explosion in the carrier located in the gun immediately beneath it, rupturing a mechanical fuse and allowing the switch to close.

14 Claims, 14 Drawing Sheets

ELECTROMECHANICAL ASSEMBLY FOR CONNECTING A SERIES OF GUNS USED IN THE PERFORATION OF WELLS

FIELD OF THE INVENTION

This invention refers in general to an integral assembly of guns to be used in the perforation of wells; particularly, it is directed to a new electromechanical assembly for connecting a series of guns used in the perforation of petroleum producing wells.

The process of well perforation consists of the perforation of the metallic casing of the well, of the isolating cement surrounding the casing, and of the layers of rock in the producing formation by means of explosives housed within perforating-guns; achieving, through bore holes produced by shaped charges, a connection between the depths of the producing zone and the interior of the well.

BACKGROUND OF THE INVENTION

The perforation of petroleum producing wells is realized by lowering into the well various metallic perforating-guns of different lengths, the respective charge carriers of which are charged with shaped charges, connected by joints and fired in a vertical fashion, one after another, resulting in a single unit of joined perforating-guns for the perforation of various zones, in a single lowering.

Each perforating-gun contains a 'carrier tube' or a charge carrier in which shaped charges, for use in the petroleum industry, of varying geometries are set. Each of the shaped charges detonate conjointly as the charges are in contact with a detonating cord, formed by a tube or vein containing in its interior an explosive granular with controlled properties, through which the explosion advances initiated by an electronic detonator. The explosion of the detonating cord detonates the shaped charges sympathetically.

Perforating guns are detonated one at a time beginning from the bottom and continuing in an upward fashion. After each detonation, the gun assembly is repositioned vertically in such a way that the lowest gun that remains active is located at the desired depth of perforation.

The detonator of each gun is activated by an electronic signal sent from the surface to the mouth of the well, by way of an electronic cable, the conductor of which is protected by a steel wire-mesh. Despite having but a single conductive wire to carry any electrical tension to the gun assembly, the charge is passed through diodes and polarized after the detonation of the bottom gun, so as to ensure that the electric current only arrives at the desired gun.

To fulfill the operation so briefly described, while simultaneously respecting existing norms for the manipulation of explosives, highly capable operators are required to arm and assemble the guns and the wellhead, stripping the ends of connecting wires and joining them by twisting the exposed portions of the wire together and covering the joint with adhesive electrical tape, resulting in an 'artisanal' activity requiring extreme caution. It should be noted that petroleum production and exploration activities are generally located in areas with hostile climatic conditions for the operators; work hours are assigned in accordance to the needs of the operation and may include nighttime and daytime hours, with extreme cold or heat, rain or wind, darkness or sunlight. Hours are controlled by working against the clock and by penalizing setbacks; to that respect, it is absolutely necessary that the strictest safety norms be followed while handling explosive material; all of these factors together contribute to an increased likelihood that operators may commit errors while wiring or assembling the perforating guns to be introduced into the well.

From the above facts, there exists an obvious need to simplify the operation of arming and assembling the perforating gun assembly, in other words, simplification of the mechanical assembly and electrical connections of the gun assembly to establish the required firing sequence. The object of this invention deals with the means to perform the electromechanical connection of the gun assembly.

SUMMARY OF THE INVENTION

Facing the current state of the techniques on the subject, an improved perforating gun assembly for use in petroleum producing wells is proposed, where each gun takes the form of a hollow tube of highly resistant steel serving as a casing, within which a charge-carrier loaded with shaped-charges, set in radial fashion along the full length of the charge carrier in accordance with the needs of the client. The carrier is a tube with a slightly smaller diameter than that of the interior of the perforating gun. The shaped-charges are in contact with a detonating cord, comprised of a vein filled with explosive granular that is in contact with an electronic detonator. Each gun is mounted, coupled with other similar guns, in vertical fashion within the casing of the well, forming an assembly, connected to the surface by an electrical connection, by which the guns will be detonated, beginning with the lowest gun that remains active.

The improvements proposed as the basis of this invention can be summarized as follows:

- Providing a system for connecting wires with a clip which design permits the arming and assembly of the perforating guns without the possibility of error, which can cause failures in the operation and generate large economic losses, and/or may cause unfortunate accidents.
- Being able to wire the assembly by using said clips makes wiring an easier task and requires less time, meaning less time with personnel working with explosive material.
- As a security improvement, the detonators utilized in the gun assembly remain short-circuited and grounded until the preceding gun is detonated; only in that moment, is the detonator connected to the live electric line which stretches the entire length of the carrier allowing for the conduction of the detonating charge; however, a diode prevents the detonator from firing from a charge of the same polarity as the gun previously fired: to detonate, one must change the polarity of the charge. This implementation of this improvement increases security while working with explosives.
- A pressure activated electromechanical changeover switch. The switch has a conductive dart, which is activated at a predetermined pressure set by a mechanical fuse in the shape of an expendable ring that breaks under stress from the explosion. On receiving the impact produced by the explosion of the shaped charges located in the charge carriers of the lowest active gun in the gun assembly, the dart breaks the mechanical fuse and trips the switch. The dart acts as a switch between contacts that are exposed in the housing of the apparatus and releases the detonator from short-circuit and ground, connecting the detonator of the gun immediately above the fired gun to the circuit. This allows said detonator to later receive the electronic tension, albeit with opposing polarity to the previous gun. This switch, while it is in its initial position, in repose, before moving, allows the electrical charge, positive or negative, to reach the bottom gun and maintains the remaining and unfired portion of the gun assembly short-circuited and grounded.

Each charge carrier is limited to two insulating and centralizing end plates: the bottom with a central orifice through which the firing line and the unit ground to a tab located on the outer edge of the end plate pass, placing the unit ground in contact with the outer shell of the gun, that acts as the ground for the entire gun assembly (bottom end plate without retractable contact pin), both cables are tied to a connector; and the top end plate that has a spring-loaded electrical contact pin which function is, on one hand, to assure constant electrical contact with the preceding switch, in spite of variances in lengths that can be produced, and on the other, prevent failure of the cables that connect the guns due to twisting, as frequently occurs with current practices. The bottom plate without said pin, functions to connect the ground to the gun assembly, and to space and centralize the charge carrier within the gun. Both end plates serve to protect the elements that form the series of guns (top sub, tandem sub, and bottom sub) from fragments produced by the explosion, in such a way that these parts may be used again.

BRIEF DESCRIPTION OF THE DRAWINGS

In the attached figures.

In all figures, like reference numbers represent corresponding or substitute elements.

Figure 1:
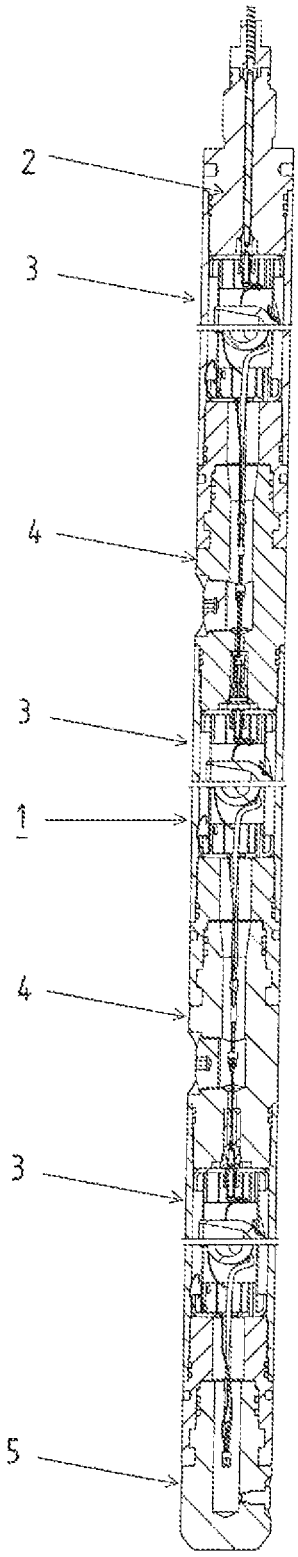
FIG. 1, is a schematic dissection that shows an assembly of three armed and assembled cannons in a manner that is in accordance with this invention.

LIST OF MAIN REFERENCES (1) Assembly of three armed guns
(2) Firing Head (Top Sub)
(3) Perforating Guns
(4) Tandem Sub (Intermediate)
(5) Bottom Sub
(6) Adaptors
(11) Conducting axial rod with insulating sheath
(12) Upper conical contact
(12*i*) Lower conical contact
(13) Charge-Carrier
(14) Insulating top end plate
(15) Isolating bottom end plate
(16) Explosive shaped-charges
(17) Diode switch or pressure activated changeover switch
(18) Electronic detonator
(19) Detonating cord or fuse
(20) Lateral cap of each tandem sub (4)
(21) Retractable moving contact pin of the upper end plate (14)
(22) Ground connecting tab of the bottom end plate (15)
(23) Central passage orifice for wires in end plate (15)
(24) Anchoring slots for the end plate (14)
(25) Flexible centralizing rabbets of end plate (14)
(26) Centralizer for the mounting of the retractable contact pin (21) in end plate (14)
(Cs) Connector of diode switch
(Cs1) First pair of opposing notch shaped recesses of (Cs)
(Cs2) Second pair of opposing notch shaped recesses of (Cs)
(Cs3) Interior contacts of (Cs1)
(Cs4) Interior contacts of (Cs2)
(Cd) Connector or clip connector for the detonator
(Cd1) Elastic (retractable) contacts of (Cd)
(Cd2) Orifice for the wiring from (Cd)
(Cd3) Neck or entrance of (Cd)
(Cc) Connector or clip connector for the carrier
(Cc1) Elastic (retractable) contacts of (Cc)
(Cc2) Openings for the wiring from (Cc)
(Cc3) Neck or entrance of (Cc)
(Ca) Adaptor connector for (Cc) from the carrier to connector of the detonator (Cd)
(Ca1) First pair of opposing notch shaped recesses of (Ca)
(Ca2) Second pair of opposing notch shaped recesses of (Ca)
(Ca3) Interior contacts of (Ca1)
(Ca4) Interior contacts of (Ca2)

DETAILED DESCRIPTION OF THE INVENTION

The following is a detailed description of exemplary embodiments to illustrate the principles of the invention. The embodiments are provided to illustrate aspects of the invention, but the invention is not limited to any embodiment. As those skilled in the art will appreciate, the scope of the invention encompasses numerous alternatives, modifications and equivalent; it is limited only by the appended claims.

In relation to FIG. 1, the gun assembly (1) has a firing head (2), three guns (3), each containing a charge-carrier, two tandems (4), three adaptors (6), and a bottom sub (5). The mentioned parts are tubular pieces provided at the ends of the elements of the machined joint that will be described briefly as they are not included within the sphere of protection of this invention.

Figure 2:
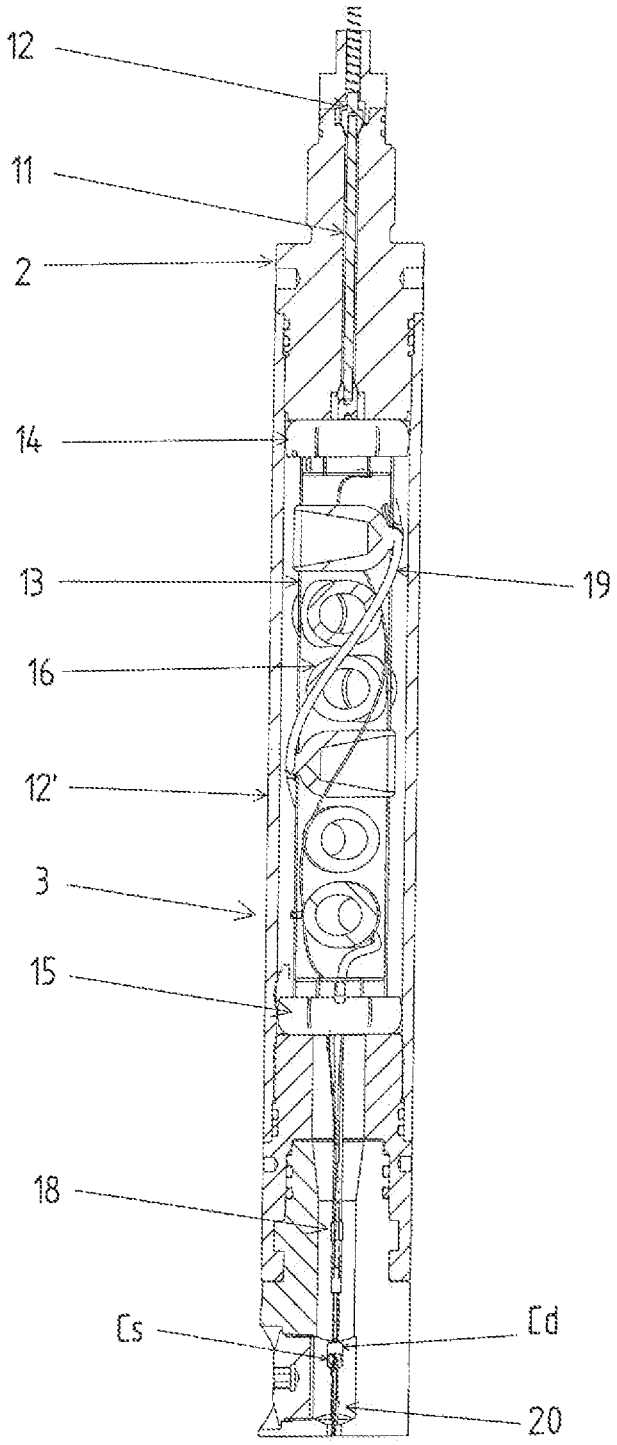
FIG. 2, is a schematic dissection of an assembly consisting of a firing head (top sub), perforating gun, charge carrier, and a tandem sub with a pressure activated changeover switch.

FIG. 2, shows the firing head (2) with an axial orifice through which an insulated metallic rod with a 'spaghetti' vein (11) passes. Through the upper conical contact (12) the rod connects to the 'live', originating from the surface, the casing connects to the ground, through a steel armature in the conducting cable (not illustrated), which in turn supports the entire gun assembly.

The first gun (3) is a treated steel tube and contains a charge-carrier (13) having a tube (not visible in the figure) of a slightly smaller diameter than the diameter of the interior of the gun (3), and two centralizing end plates, the bodies of which are made of insulating material; the top end plate (14) with the retractable contact pin (21) and the bottom isolating end plate (15). More detail on the end plates will be provided below.

One can see in the interior of the carrier, (13) two shaped-charges (16) are shown set in radial fashion, that is to say, perpendicular to the gun wall, to the carrier, and, when the guns are within the well, to the well casing. It should be noted that for clarity purposes only two shaped-charges are included in the illustration, while the number of charges in a carrier will generally be greater.

The shaped charges are explosives set in such a manner that they concentrate the force of the explosion outward, generating a jet of gas (plasma) at high pressure and temperature, that pulls the metal from the interior of the charge and projects it outward until it arrives at the well formation, with this action the charges produce a perforating effect that is variable in proportion to the potency of the charges.

In each intermediate joint, or "tandem sub" (4) one can see the lateral cap (20), the pressure activated changeover switch (17), the function of which shall be explained herein, from which wires connected to a connector (Cs), that will be connected to the detonator connector (Cd) and to the carrier connector (Cc), extend. When the detonator is activated, a detonation is propagated by way of a "fuse"—or detonating cord (19)—to each of the shaped charges in the carrier (13) that burst in simultaneous fashion within the corresponding gun (3).

Upon placing the shaped-charges within the charge-carrier (13) of the guns, the gun assembly (1) is armed with a firing head (2), tandem subs (4), adaptors (6), and bottom sub (5). The total electromechanical connection of the well remains ready upon connecting the diode switch (Cs) with the carrier connector (Cc) and, lastly, connecting the diode switch (Cs) and the detonator connector (Cd); the detonator is then connected to the ballistic system and the assembly is finalized with the placement of the lateral caps (20) and the bottom sub (5).

Although not described herein, the internal details of the assembly are protected by a watertight seal, otherwise the liquids present in the well would enter into the interior of the gun causing problems with the electric and/or ballistic systems.

Figure 3A:
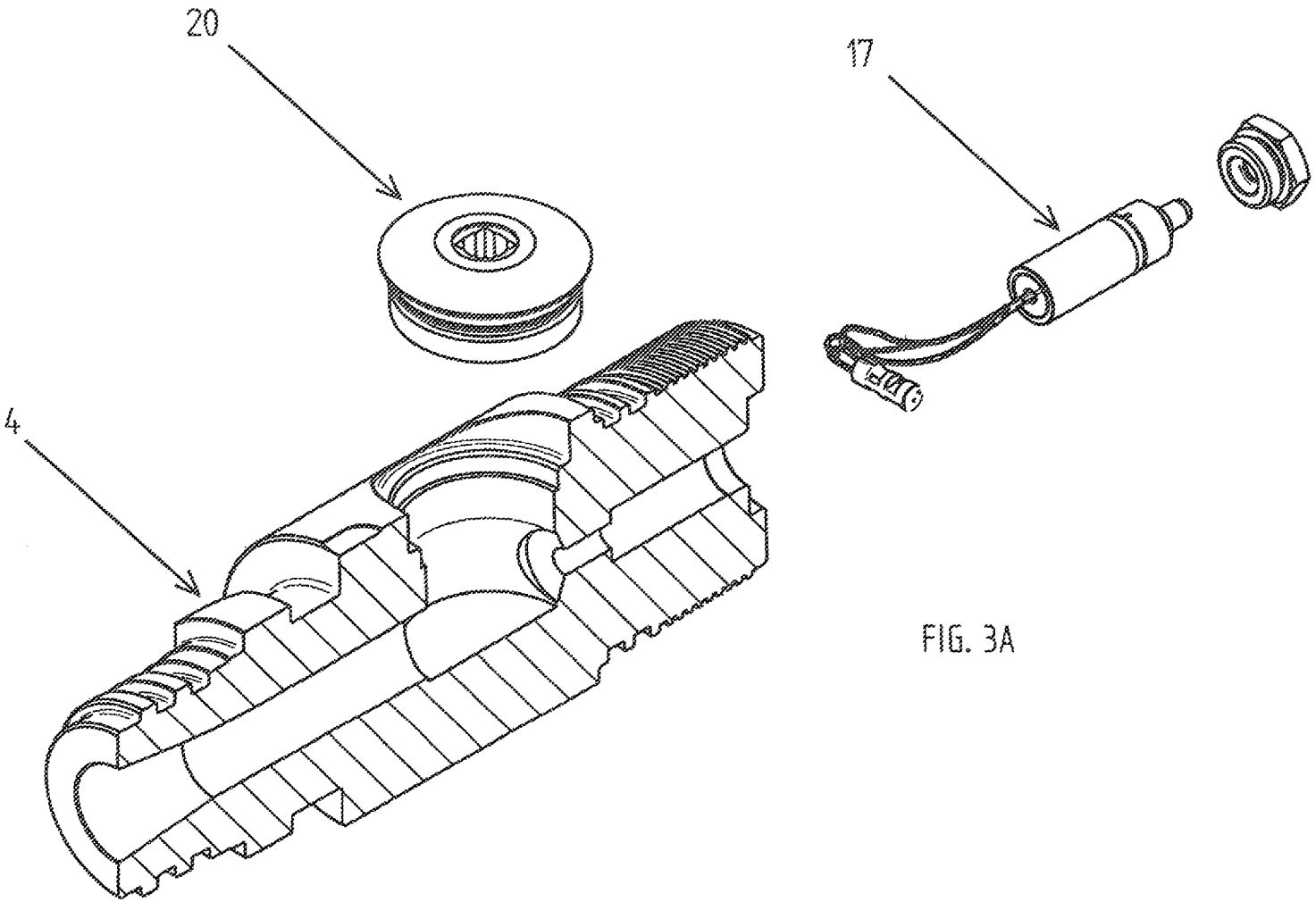
FIG. 3A, is a detailed (partially dissected) view of a tandem sub, with its lateral cap and diode switch in their respective positions, but not inserted into the gun assembly.
Figure 3B:
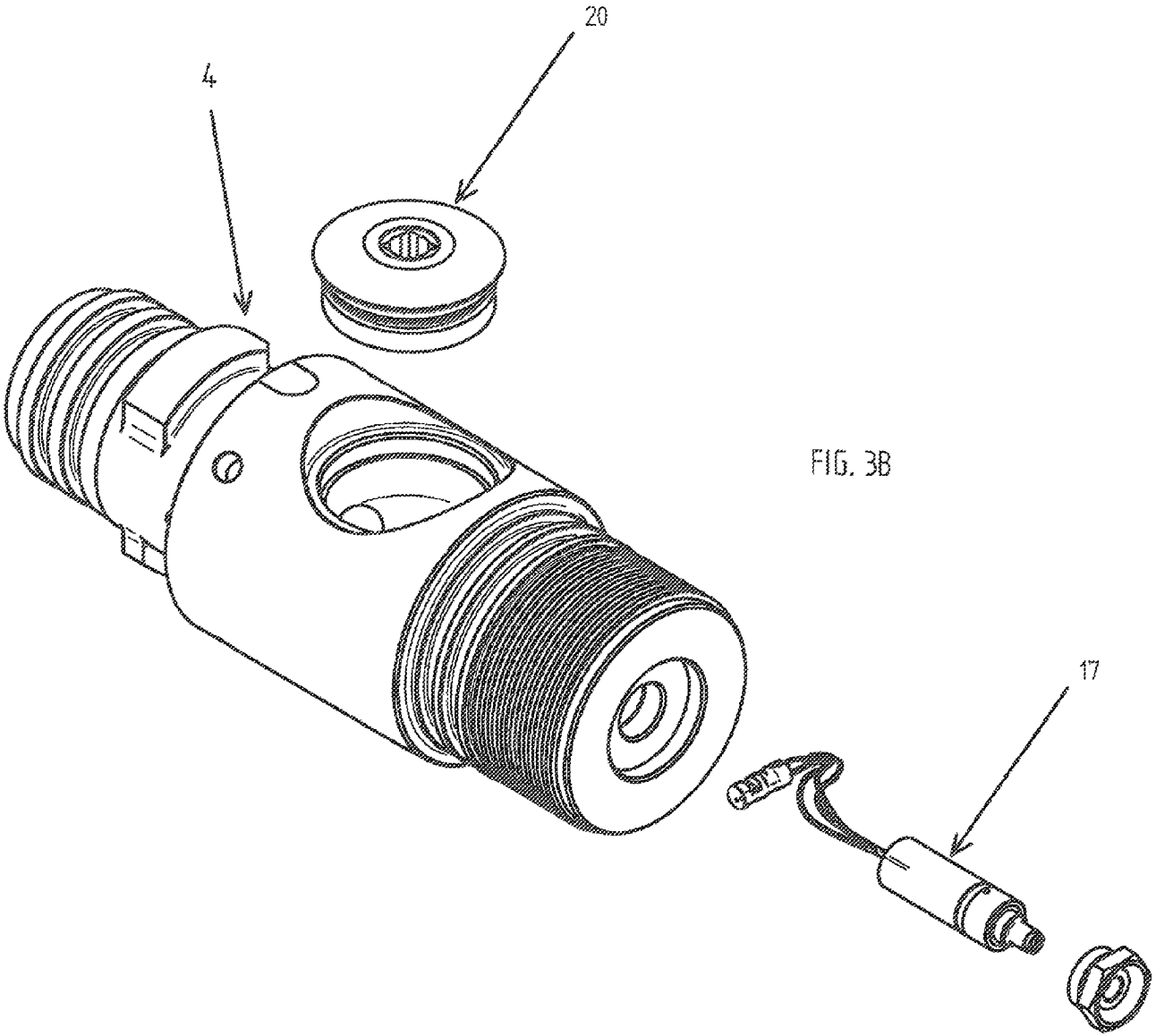
FIG. 3B, is another detailed view of a tandem sub, opposite that of FIG. 3A, with its lateral cap and switch in their respective positions, but not inserted into the gun assembly.

FIGS. 3A and 3B show a detailed dissection of a tandem sub. One does not only see the body of the tandem sub (4), but also the lateral cap (20), the switch (17), both in their correct orientation, but separated from the body of the tandem (4). In this figure, the detonator is not shown.

Figure 4A:
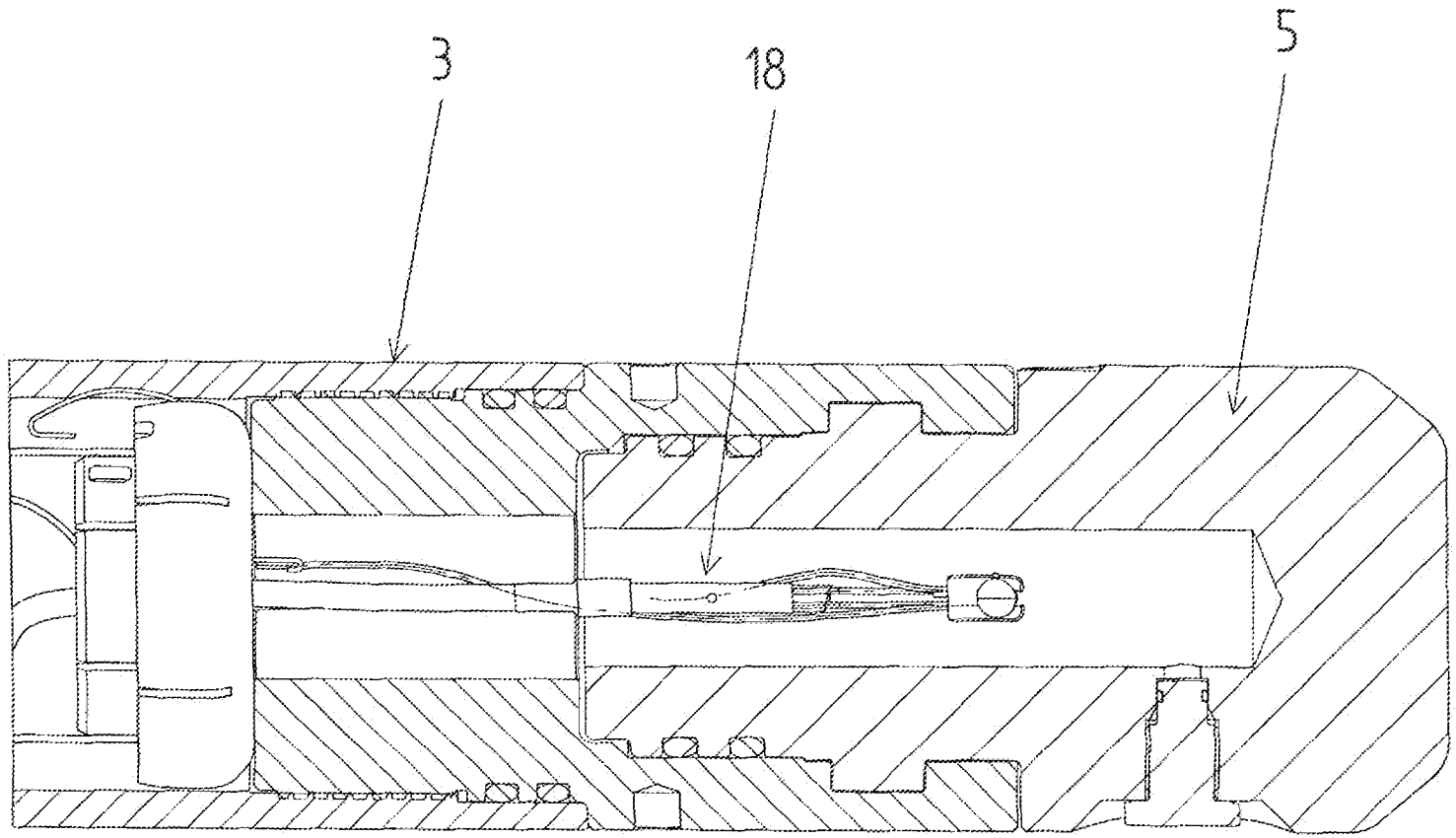
FIGS. 4A and 4B, are a view of the bottom sub showing it in two positions with a 90° rotation.
Figure 4B:
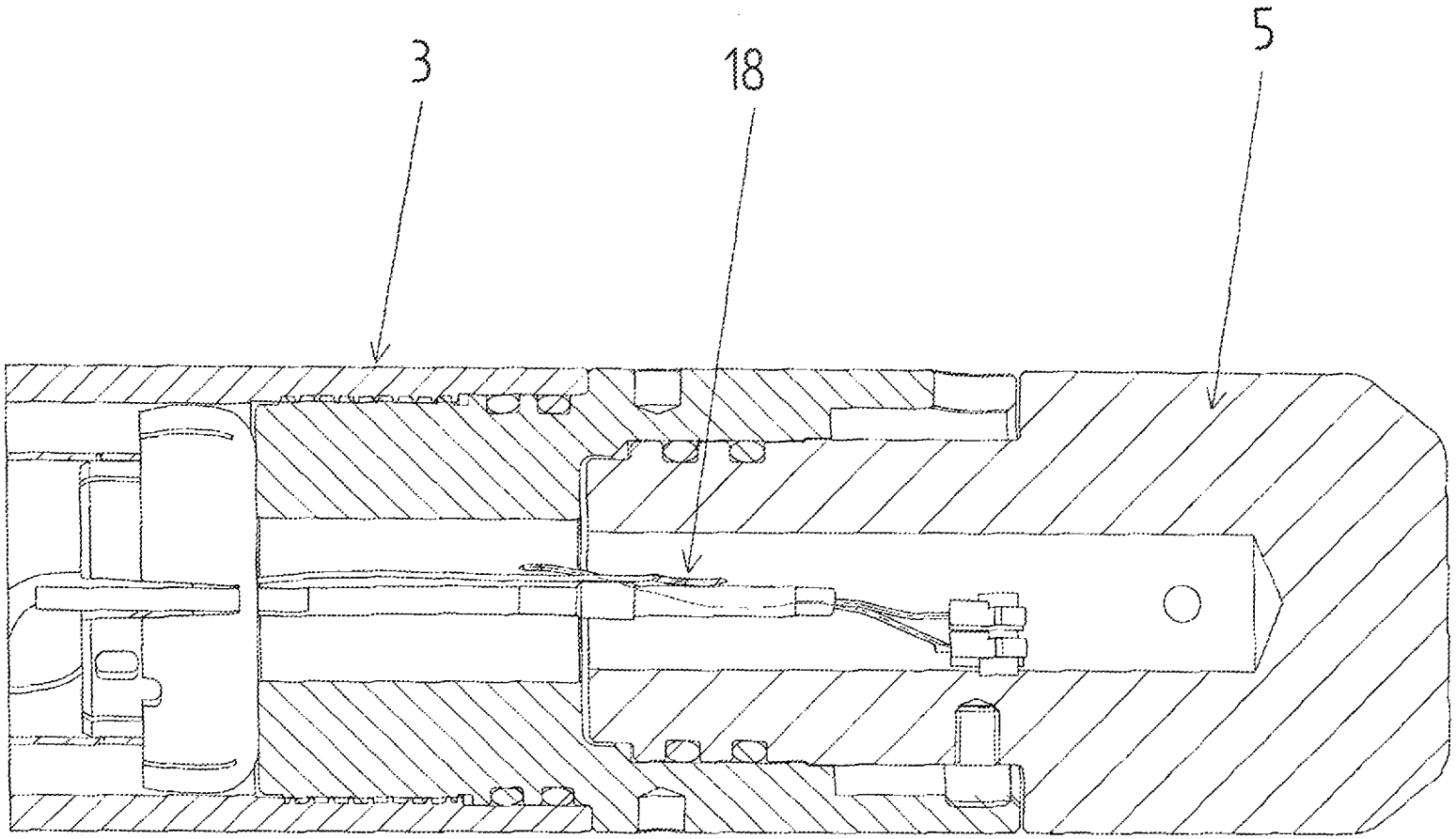

FIG. 4 shows, in two perspectives, the bottom sub (5), that is mechanically linked to the adaptor (6) of the bottom gun (3).

Figure 5A:
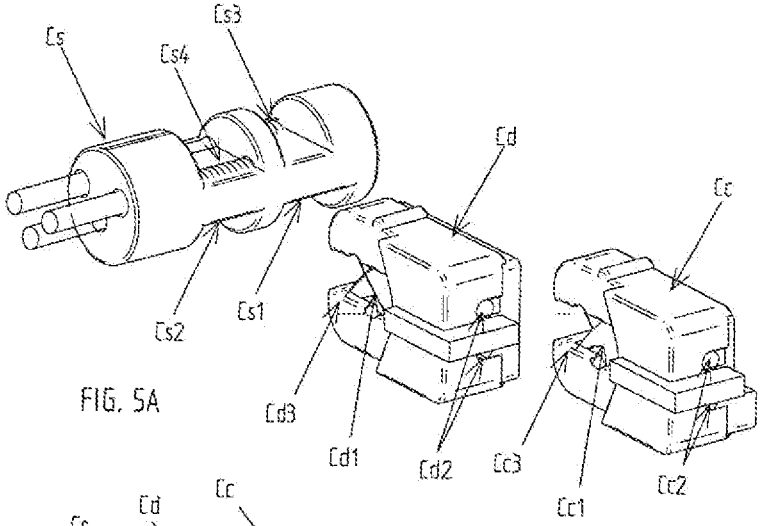
FIG. 5A, is a detailed view of the connector switch, the connector for the detonator and the carrier connector, showing each in separate projections.
Figure 5B:
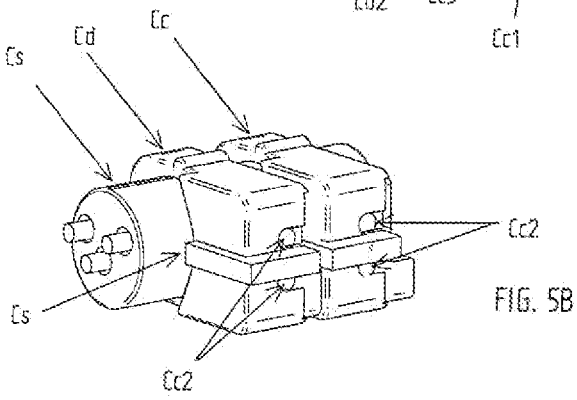
FIG. 5B, is another detailed view showing the elements from the assembly in FIG. 5A in their connected state.
Figure 5C:
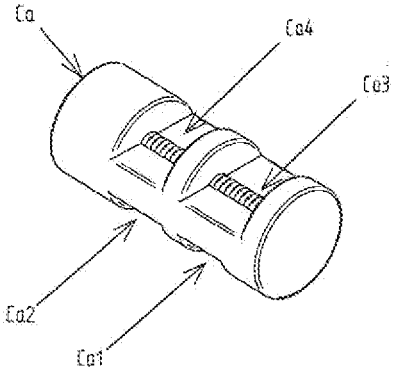
FIG. 5C, is another detailed view of a carrier connector adaptor (Cc) of the detonator connector (Cd)
Figure 5D:
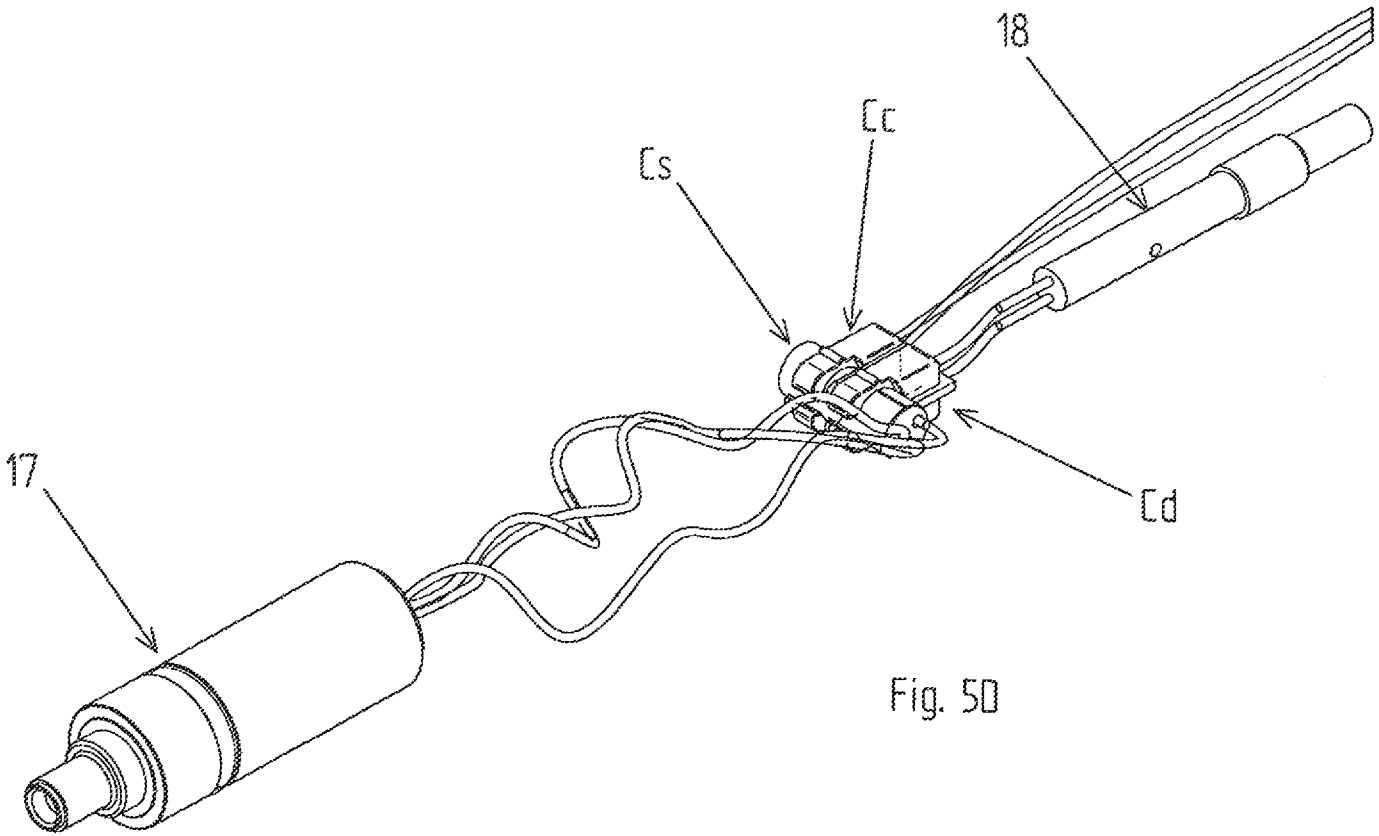
FIG. 5D, is another detailed view showing the connection from FIG. 5B, including the switch and detonator.

FIGS. 5A, 5B, and 5D represent the electronic connections in the upper guns between diode switch (Cs) and carrier connector (Cc) and detonator connector (Cd).

Figure 5E:
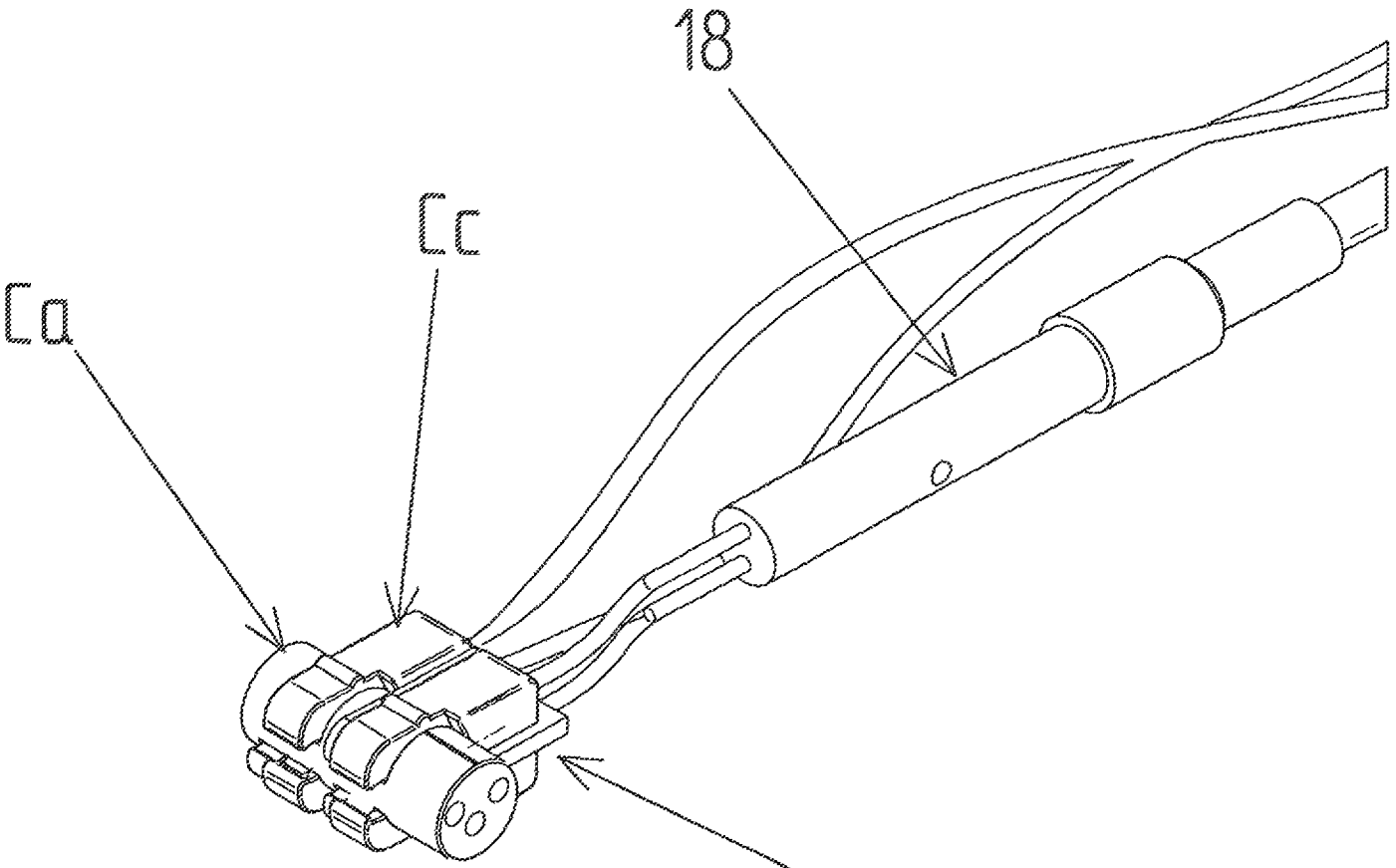
FIG. 5E, is another detailed view of a possibility of connection utilizing the connector from FIG. 5C and the detonator.

The bottom sub (5) is always located with the bottom gun, and for the electrical connections between the detonator (Cd) and the carrier connector (Cc), adaptor connector (Ca) should be used, as shown in FIGS. 5C and 5E.

According to a notable characteristic of this invention both connectors, female clips (Cd) and (Cc), have two elastic contacts, (Cd1) and (Cd2), which, when the male connector (Cs) is not connected, remain in contact with one another, or short-circuited. In the context of the detonator, it is an absolutely necessary security feature that the detonator cables remain in short-circuit; currently, this is done by stripping the detonator wires by hand each time a detonator (18) is handled. Connector (Cd) automatically places the system in short-circuit every time it is disconnected from the electrical circuit, avoiding risk of accidental detonation due to human error. Furthermore, the connectors have been designed to prevent incorrect or inverse connection of the clips; except for when connectors (Cc) and (Cd) have the same shape and function, it is impossible to exchange connections.

To achieve these objectives in the manner in which this invention was designed, the connectors (Ca) and (Cs) have bodies, or cylindrical housings, with opposing transverse recesses, by way of consecutive notches, (Cs1), (Cs2), (Ca1), (Ca2). Within the internal portion of said recesses the respective contacts (Cs3), (Cs4), (Ca3), (Ca4), remain exposed. The connector switch (Cc) and detonator (Cd) comprise female clips being the bodies (or housings) of which rectangular prisms in shape, having at one end orifices (Cc2) and (Cd2) for connecting the corresponding wiring and on the opposite end an inlet, or neck, (Cc3) and (Cd3) in the shape of a "U", in which retractable contacts (Cc1) and (Cd1) are exposed. The width of each inlet of each connector is only congruent with one respective pair of recesses on the connector switch (Cs) or with the connector adaptor (Ca), avoiding completely the possibility of an error in connection. The housing of connector (Cs) has openings on one end for the corresponding wiring.

Figure 6:
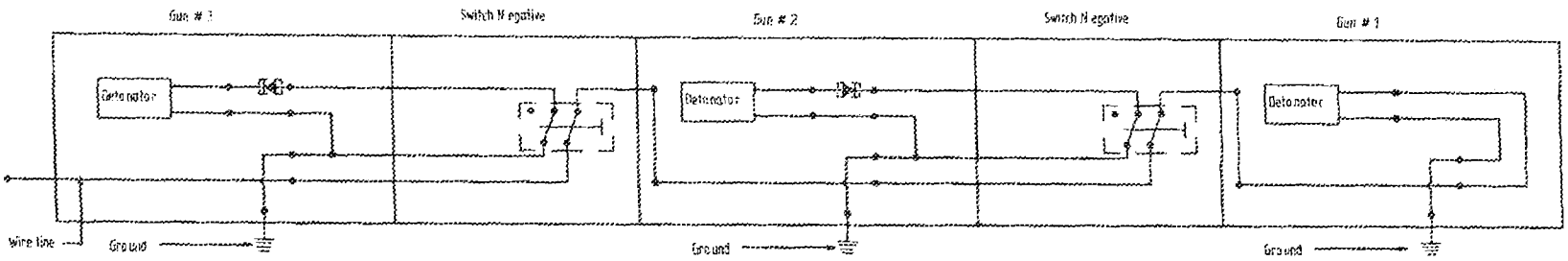
FIG. 6, is an electrical schematic of the interconnection in the gun assembly of the three armed guns in selective form.
Figure 6B:
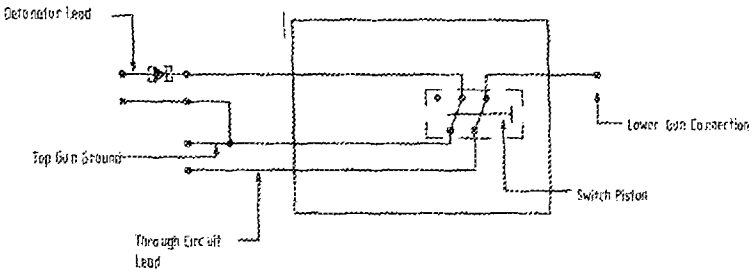
FIGS. 6A and 6B, are enlarged diagrams of the interconnections in the diode switch, positive and negative, respectively.
Figure 6A:
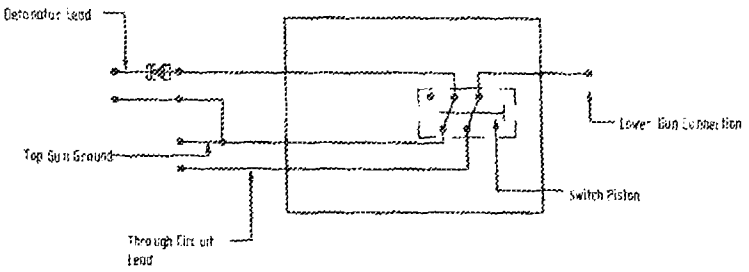

FIG. 6 shows an electronic schematic of the assembly. It should be noted that the switch is combined with a serial diode at the detonator of the top gun (3), and depending on the polarity of the diode, it will be denominated either "positive diode switch" or "negative diode switch": in the first case, only one polarity of voltage, positive, coming from the surface via the "live" wire can activate the detonator, while in the other case the detonator shall only activate in the presence of a negative pulse.

In the connection scheme in the lower part of FIG. 6—where the connector or tab joints are not illustrated—the left represents the upper part of the assembly and the right, the lower. The 'live' arrives to the lower detonator (first gun) passing through the positive switch of the third gun and the negative switch of the second gun, which are in their normal positions, or initial repose. Just as it is illustrated, whatever polarity the charge applies to the 'live' wire shall detonate the first gun, however the polarity that will be used is positive. The detonation will cause the pressure in the first gun to increase significantly, causing the negative switch to activate, and even when the positive charge from the shot is applied to the live wire, the diode in the second gun impedes detonation. This gun will detonate when the live charge is negative. In that case, the second gun will generate sufficient pressure to cause the positive switch to activate, but, again, the charge, this time negative, will be impeded by the diode. The detonation in the third gun will be produced when the charge is once again switched to positive. It should be clear then that this setup allows the guns to be detonated from the bottom upward. Each canon should be detonated in the appropriate time, that is, after the detonation of a lower gun. Then the gun assembly is repositioned to a chosen perforation depth where the next gun will be detonated.

As it can also be appreciated in FIG. 6, while the switch is in its normal position of repose, the detonator of the gun immediately above is short-circuited and grounded, caused by said switch. Only after the action of the switch, caused by the detonation of the lower gun, will the short circuit be opened, allowing for the possibility that at the next change of polarity the gun will fire.

Figure 7A:
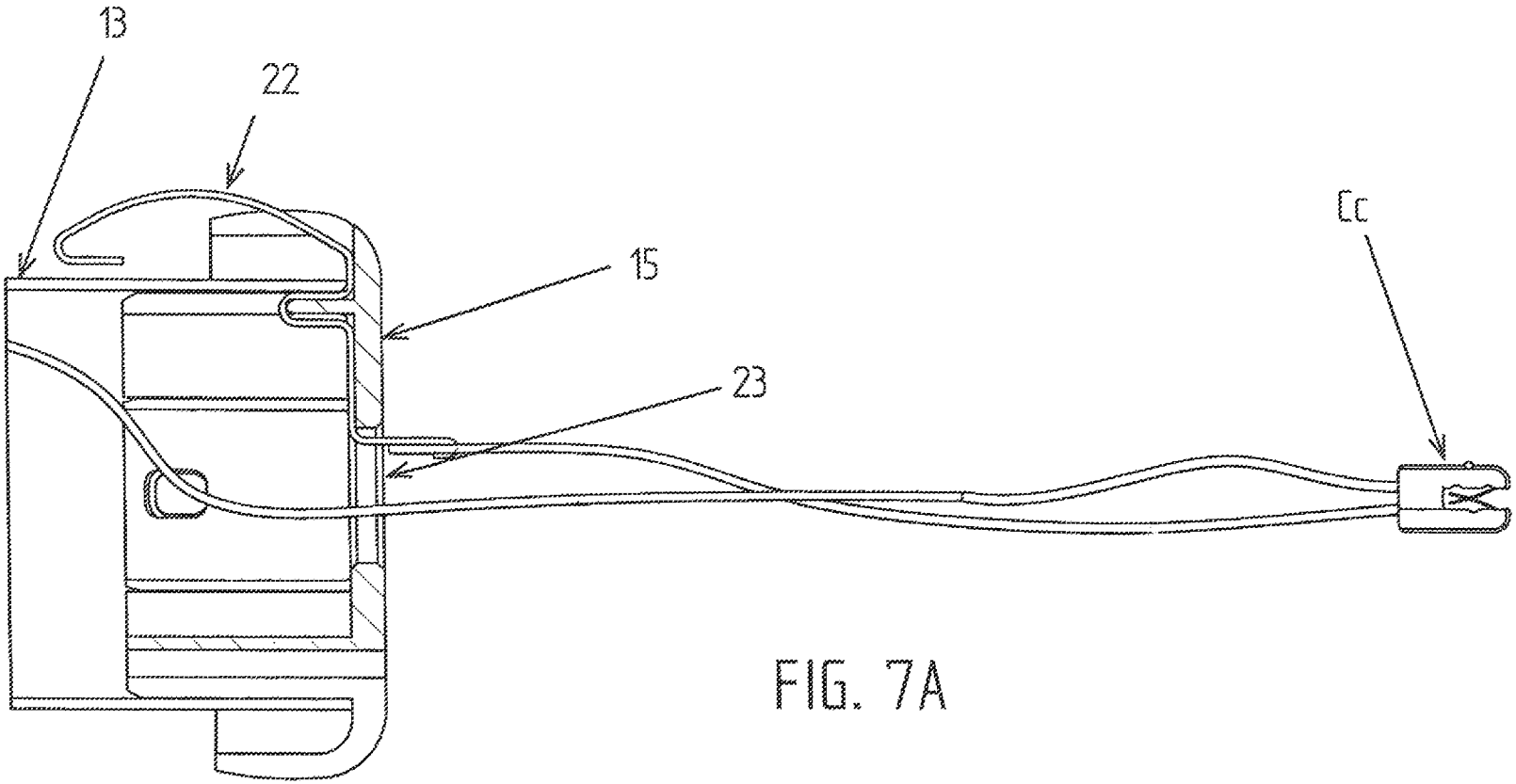
FIG. 7A, shows a perspective model of the preferred application of the insulating centralizing bottom carrier end plate.

In FIG. 7A, the insulating end plate is represented as being attached to the lower end of the charge-carrier (13), and has a tab for connecting the ground wire (22) from the carrier to the interior of the gun housing; furthermore, it has a hole, or central orifice, (23) that permits the passage of a pair of wires, 'live' and 'ground', with the carrier connector (Cc), which joined to the switch connector (Cs) permits the switch located in the tandem immediately below to pass the line to the retractable contact pin from the end plate (14) mounted to the charge-carrier in the gun immediately below.

Figure 7B:
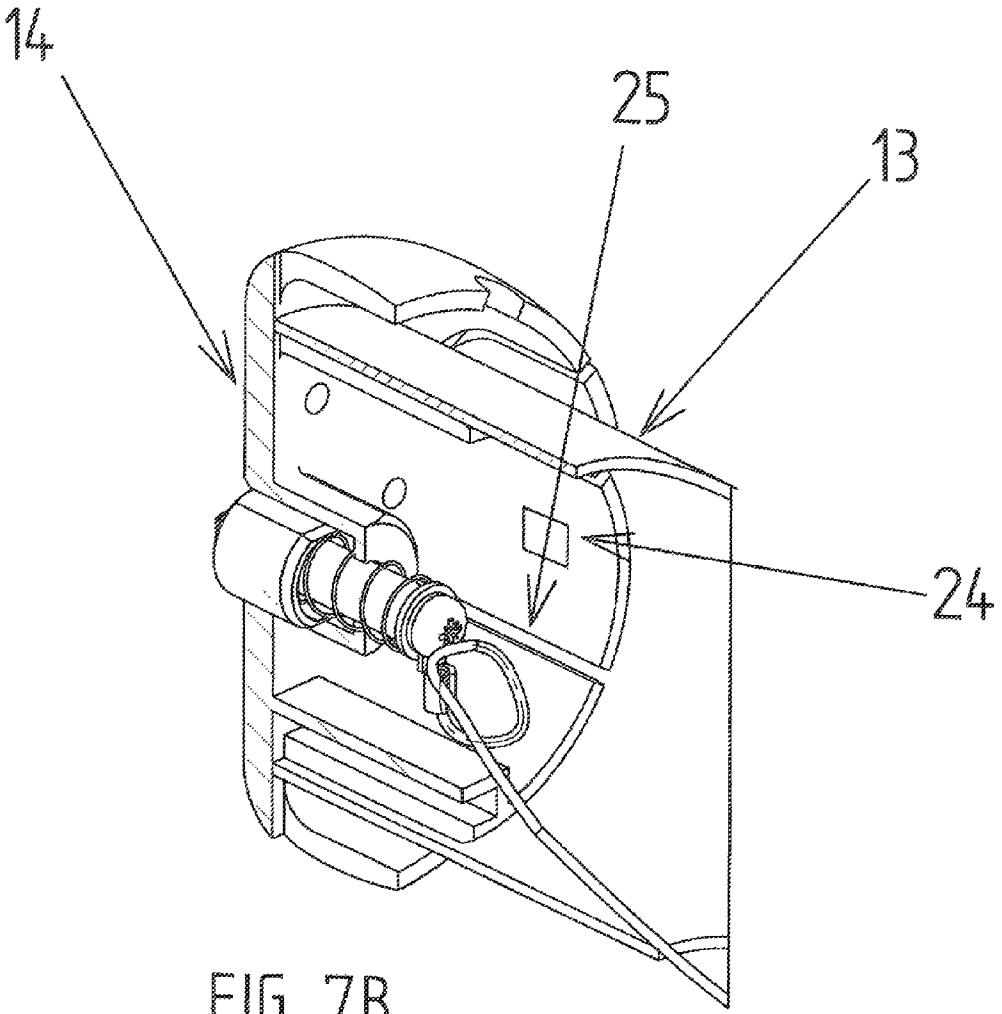
FIG. 7B, shows a perspective model of the preferred application of the insulating centralizing top carrier end plate.
Figure 8:
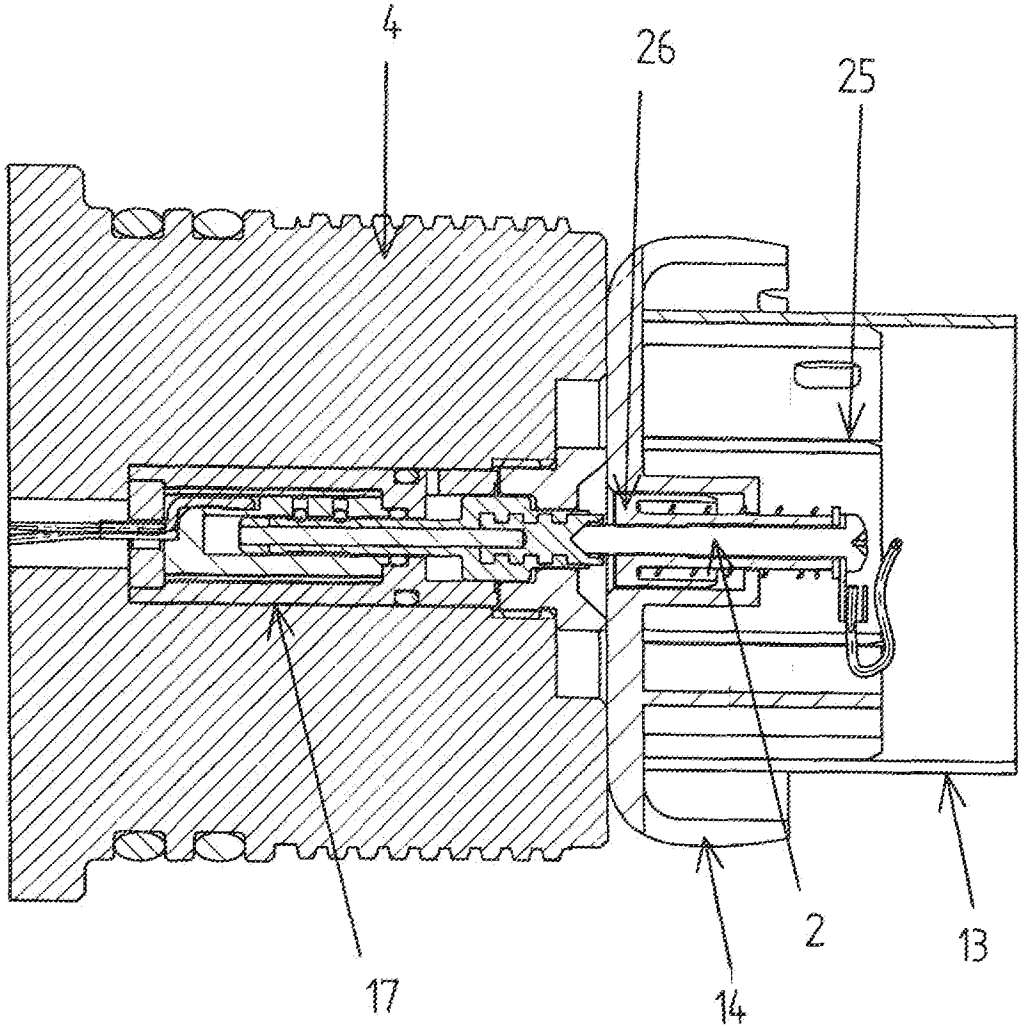
FIG. 8, is a partial longitudinally dissected view showing a tandem sub with the corresponding diode switch, coupled with a carrier by way of an end plate with the corresponding retractable contact pin in accordance with FIG. 7B.

In FIGS. 7B and 8 the end plate (14) with the retractable contact pin (21) is shown, and is represented on the upper end of the charge-carrier (13). From the top the end plate (14) protrudes a moving contact point that will make contact with the piece above the carrier: it may be the central contact of the firing head (2), to allow the passage of the "live" wire towards the bottom; but it may also be the bottom side of a switch, as illustrated in FIG. 8; in any case, the tension from the spring assures that the contact will be effective, and that it will adapt to any movement of parts and/or differences in length.

In this embodiment, the end plate (14) is a tubular piece with a peripheral skirt, bearing a groove (25) that allows it to adapt and center the carrier (13) within the tolerances set by the perforating-gun tube provider; furthermore, it possesses a pair of windows (24) that sit diametrically opposite the anchoring tabs (not shown) of the end plate, to secure the end plate to the lateral carrier wall. Additionally, the end plate (14) possesses a central tubular portion (26) for mounting the retractable contact pin (21), which contains a retractable plastic threaded screw that connects the line to the carrier (13).

Figure 9A:
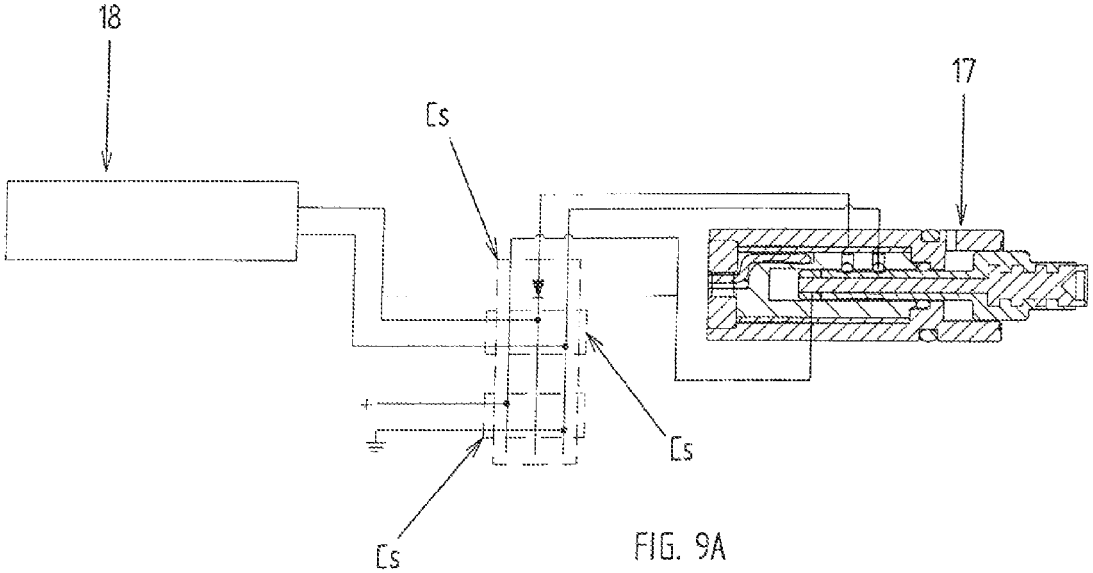
FIGS. 9A and 9B show schematically the functionality of the switch, in repose and activated, respectively.
Figure 9B:
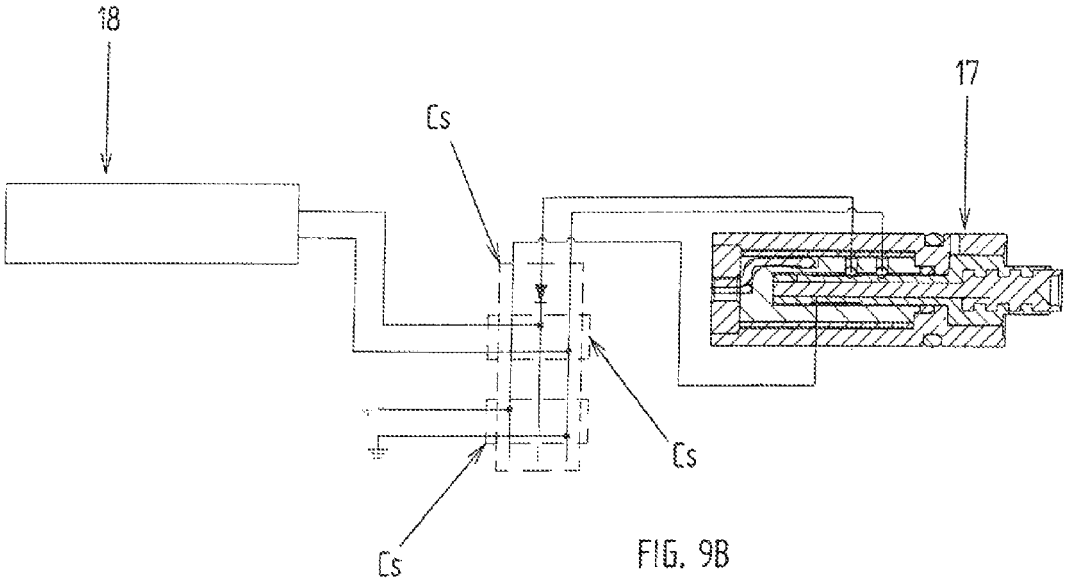

In the schematics for FIGS. 9A and 9B one can see the change in switch (17) from "repose", or inactive state, and "active", that takes place when the carrier (13) immediately below is detonated. In the moment of the switch, the mechanical fuse is destroyed (rupture of the expendable holding ring) that maintained the switch in an inactive, or 'normal', position. The electrical change is easy to follow in the figure and coincides with FIG. 6.

What is claimed is:

1. An electromechanical assembly for connecting a series of guns used in the perforation of petroleum producing wells, the assembly comprising:

a series of guns in which each gun is a hollow cylinder having an interior containing a corresponding charge-carrier that holds explosive shaped-charges; the carrier is a tube of a slightly smaller diameter to the inner diameter of the hollow cylinder, and has multiple peripheral mountings for a radial placement of the shaped-charges which are in contact with a detonation cord that contacts an electrically operated detonator; the gun is mounted, coupled with other guns, in a vertical position inside the casing of a well, forming a gun assembly, to which extends an electrical cable from the surface, for coupling an electrical signal to detonate the carrier in each gun, beginning with the lowest active gun in the series; and where the series of guns are initiated by a firing head, having been firmly joined by intermediate pieces and terminating in a bottom sub on the lower extreme of the series of guns; wherein each carrier contains an isolating insulating end plate in the lower extreme of the carrier and an insulating end plate with a retractable contact pin in the upper extreme of the carrier, both end plates having a diameter slightly greater than the interior diameter of the cylinder of the respective gun, with flexible grooves for centering the carrier and provided with a receptacle to attach said carrier, in which exterior a cylindrical surface extends with a diameter between the diameter of the interior of the hollow cylinder and the external diameter of the carrier;

said isolating end plate presents an elastic contact between the interior of the hollow cylinder of the gun and a central orifice through which wires may be passed and where said end plate with the retractable contact pin presents a passage in which an electrical contact is fixed to the center of a spring capable of applying outward pressure; and within each carrier, with the exception of the bottommost gun, a wire which begins at the bottom side of the retractable contact pin of the respective top end plate and passes through the orifice in the bottom end plate entering into an intermediate piece connecting two guns, where the wire joins with a changeover switch; the switch containing two mobile electrical contacts, which change between normally-open and normally-closed states, and wherein one contact, in a position of repose, is in a normally-open state while the other contact is normally-closed;

said switch is sensitive to high pressures originating from the explosion of a gun immediately below and sufficient to rupture a mechanical fuse, in the form of a breakable plastic ring, to activate movement of the changeover switch.

2. The electromechanical assembly according to claim 1, wherein said assembly is suspended from the surface by a single-core wire protected by steel wire armor.

3. The electromechanical assembly according to claim 1, wherein said wire is a single core electrical wire having a steel armor connected to ground.

4. The electromechanical assembly according to claim 1, wherein said firing head has in the uppermost extreme thereof, a threaded coupling with a conic insulating seat where said electrical wire and an axial rod, covered in insulating material, pass through the firing head until the electrical wire and insulating material make contact with the bottommost part of the assembly, where the electrical wire makes contact with the retractable contact pin of the top end plate of the first carrier.

5. The electromechanical assembly according to claim 1, wherein each intermediate piece between guns has a centrally located lateral opening with a threaded cap and through which passes a first ground wire connected to ground located within the carrier and through which also passes a voltage-carrying wire connected to a first female connection clip adapted to be connected to a first male connection clip that is connected to first and second common contacts of a switch located in a lowermost part of said intermediated piece.

6. The electromechanical assembly according to claim 5, wherein said first and second connection clips are manually coupled when the threaded cap of intermediate piece is removed.

7. The electromechanical assembly according to claim 1, wherein said intermediate piece includes a second male connection clip in which a cable derived from a first ground wire joins with a cable extending from a first normally closed common contact of said switch, and a second female connection clip connectable to the second male connection clip and having contacts exhibiting elastic qualities to maintain a short circuit while the second male connection clip is disconnected.

8. The electromechanical assembly according to claim 7, wherein wires of the second female clip in the bottom sub are connected to the detonator of an adjacent carrier; the wires extending from the last switch in the series of guns to the detonator of the last carrier.

9. The electromechanical assembly according to claim 8, wherein the wires of the second female clip are connected to the detonator by way of a male clip (Ca).

10. The electromechanical assembly according to claim 7, wherein the male connection clips include cylindrical housings, having openings for corresponding wiring, and having in each male connection clip, opposing transverse recesses, each containing exposed contact elements; with the housings of the female connection clips formed as two rectangular prisms with, at one side, an orifice for connecting the wiring, and at an opposite side, a U-shaped neck that contains, in the interior thereof, a pair of exposed retractable contact plates; each neck corresponding with only one respective pair of recesses on the male connection clip.

11. The electromechanical assembly according to claim 10, wherein the male connection clips are of two types; and wherein the contacts for each pair of opposing transverse recesses in the first type of male connection clips are connected and the contacts in the second type of male connection clips are insulated from one another and are bridged to contacts of the adjacent recesses.

12. The electromechanical assembly according to claim 1, further including a diode connected to the wire extending from the first, normally-closed, contact of said switch.

13. The electromechanical assembly according to claim 1, wherein the carriers are connected in sequence and the second, normally-closed, contact of a first carrier has a free end connected through an actuator of the switch with the retractable contact pin of a second carrier in the sequence with positive and negative interrupters alternating from one carrier to another.

14. The electromechanical assembly according to claim 1, wherein said switch contains a moving dart that receives an impulse when the shaped-charges, located in the carrier below, are detonated, rupturing the mechanical fuse and causing the switch to activate, thereby enabling the detonator, then in a state of short-circuit, in the carrier immediately above, to detonate.

* * * * *